US010952478B2

(12) United States Patent
Desmeules

(10) Patent No.: US 10,952,478 B2
(45) Date of Patent: Mar. 23, 2021

(54) ALL-INCLUSIVE ONE-PIECE ELECTRICAL HEATING LINER FOR ARTICLES OF APPAREL

(71) Applicant: Alain Desmeules, Montreal (CA)

(72) Inventor: Alain Desmeules, Montreal (CA)

(73) Assignee: Brook Erin De Santis, Montreal (CA)

( * ) Notice: Subject to any disclaimer, the term of this patent is extended or adjusted under 35 U.S.C. 154(b) by 268 days.

(21) Appl. No.: 15/932,479

(22) Filed: Mar. 5, 2018

(65) Prior Publication Data

US 2019/0269180 A1 Sep. 5, 2019

(51) Int. Cl.

| | |
|---|---|
| ***H05B 3/00*** | (2006.01) |
| ***A41D 13/005*** | (2006.01) |
| ***A41D 1/04*** | (2006.01) |
| ***A41D 3/00*** | (2006.01) |
| ***A41D 27/04*** | (2006.01) |
| ***A41D 19/00*** | (2006.01) |
| ***A41D 1/06*** | (2006.01) |
| ***A47G 9/08*** | (2006.01) |
| ***A41D 19/015*** | (2006.01) |

(52) U.S. Cl.

CPC ..... *A41D 13/0051* (2013.01); *A41D 1/04* (2013.01); *A41D 1/06* (2013.01); *A41D 3/00* (2013.01); *A41D 19/001* (2013.01); *A41D 19/0044* (2013.01); *A41D 19/01535* (2013.01); *A41D 27/04* (2013.01); *A47G 9/086* (2013.01); *A41D 2400/12* (2013.01); *H05B 2203/036* (2013.01)

(58) Field of Classification Search

CPC ..... A41D 13/0051; A41D 19/001; A41D 19/0044; A41D 19/01535; A41D 1/04; A41D 1/06; A41D 2400/12; A41D 27/04; A41D 3/00; A47G 9/086; H05B 2203/036

USPC ..... 219/211, 217, 526–529, 546–549

See application file for complete search history.

(56) References Cited

U.S. PATENT DOCUMENTS 2,569,569 A * 10/1951 Maslin ..... A41D 15/002 2/75
2,713,685 A * 7/1955 Samuelnachem ..... A41D 1/06 112/424
2,777,130 A * 1/1957 Keller ..... A41D 15/00 2/75
3,768,156 A * 10/1973 Caird ..... H05B 3/342 29/611

(Continued)

*Primary Examiner* — Sang Y Paik

(74) *Attorney, Agent, or Firm* — Guy J Houle; Houle Patent Agency Inc.

(57) ABSTRACT

An all-inclusive electrical heating liner for use in the fabrication of articles of apparel is disclosed. It is comprised of a thermally insulating fabric piece which is shaped to define a dorsal panel and a pair of frontal panels to which are secured patterns of heating wires at specific locations. The spaced relationship between the dorsal panel and the pair of frontal panels is adjustable whereby the liner can be incorporated in articles of apparel of different sizes including small. Medium, large and X-large apparel sizes and gender types. The liner incorporates a power supply, controls, switches, wiring, connectors and other components thereby facilitating the incorporation of the liner into an article of apparel resulting in a cost reduction to the manufacturer of heated articles of apparel. Various embodiments are described to show that the all-inclusive one-piece heating liner is adaptable to many articles which require control heating.

20 Claims, 10 Drawing Sheets

(56) References Cited

U.S. PATENT DOCUMENTS

| | | | | |
|---|---|---|---|---|
| 5,032,705 | A * | 7/1991 | Batcheller | A41D 13/0051 219/211 |
| 5,148,002 | A * | 9/1992 | Kuo | H01Q 1/273 219/211 |
| 5,893,991 | A * | 4/1999 | Newell | A41D 13/0051 219/211 |
| 2006/0064797 | A1* | 3/2006 | Pyeatt Rowe | A41D 15/00 2/244 |
| 2008/0116189 | A1* | 5/2008 | Fernandez | A41D 13/0051 219/211 |
| 2008/0197126 | A1* | 8/2008 | Bourke | A43B 7/025 219/634 |
| 2015/0230524 | A1* | 8/2015 | Stevens | H05B 3/34 219/211 |

* cited by examiner

ALL-INCLUSIVE ONE-PIECE ELECTRICAL HEATING LINER FOR ARTICLES OF APPAREL

FIELD OF INVENTION

The present invention relates to an all-inclusive electrical heating liner for use in the fabrication of articles of apparel and wherein the liner contains electrically heating zones, a power supply, a controller, an on/off switch and all associated accessories and can be easily incorporated in the fabrication of articles of apparel of different sizes and of different types and other suitable articles formed of fabric materials.

BACKGROUND OF THE INVENTION

It is well known in the art to fabricate articles of apparel with integrated heating pads located at specific areas of the article of apparel whereby to provide heat and comfort to the user person. Such articles of apparel are usually of the type worn in winter months when climatic conditions can get very cold. Many of such articles of apparel tend to be very bulky and cumbersome and not comfortable to the user person when heating pads are attached to the liner of the article and loose wiring and cables are secured in place and connected to batteries, a control and one or more switches. Such unorganized attachment not only render the article more bulky but can represent a hazard at the connection points of wires and also resulting in malfunction, and this is particularly so if the article is subjected to stretching and tumbling during wash and dry cleaning or during activities of the wearer person. Accordingly, the article no longer has its utility that being of providing heat. There is a need to overcome such eventual problems.

Another problem in the fabrication of such articles of apparel, is that during the assembly and connection of the various component parts, there is the risk that wires become severed by the stitching needles of high speed sewing machines not to mention the difficulty of positioning the different components and wiring that has to be secured at precise locations inside the article of apparel during fabrication. If trimming of the fabric to which the liner is secured is required during installation, the use of scissors could accidently cut a wire rendering the entire heating system inoperative. Therefore, skilled labor is required in order to ensure that the heated garment is properly constructed. Such skilled labour adds to the cost of manufacture of heated articles of apparel.

Because of the high cost of heated articles of apparel they are currently available in limited types of garments, such as winter jackets for leisure or work use, ski garments, and motorcycle jackets, to mention a few. Because the batteries have limited charges the heating circuits can only operate for specific time periods, other than heated garments, such as motorcycle wear which can be plugged into a connector of the battery of the motorcycle. When batteries become discharged the utility of the heated article of apparel is no longer available and, the charging of batteries requires time for charging. Therefore, the heating feature of the article of apparel has limited time use unless the batteries are changed and this is usually not possible. Also, when the wearer person is in an area wherein there is no access for recharging batteries, the article of apparel does not provide its intended use. The carrying of extra charged batteries is not a viable solution has it adds weight and requires a means for its storage on the wearer person. The batteries can also become discharged if the wearer person forgets to shut off the batteries after removing the article of apparel.

Most of the heating circuits for such articles use metal wires. Unfortunately, these heating wires become bulky when tied together in bundles or cable form and form displeasing esthetics on the outer surface of the article of apparel. These wires and wire bundles must be properly installed in the garment to provide for the wear and tear of the article when used, thus compensating for arm and body movements and particularly to the stretching and tumbling of the article during washing and drying in machines. When wires become disconnected or broken the entire heating system incorporated in the article of apparel becomes useless and difficult and costly to repair. There is therefore, a further need to prevent these additional problems.

As mentioned above, heated articles of apparel require controls for operation by the wearer person. Such controls are usually quite bulky and heavy with wires connected thereto which makes it cumbersome to store with the wires often becoming entangled and disconnected from the control. Such controls are usually stored in a pocket specifically sewn to the article of apparel and not easily accessible to the wearer person. An on/off switch to actuate the heating system is usually made accessible to the wearer person and in some cases provide for selection of a few heating levels. Due to the use of rechargeable alkaline batteries, the heating output wattage is limited and the time of operation is usually very short. Therefore, the usefulness of the heated garment to keep the wearer person warm for any prolong period of time, is limited. Such problem has been somewhat reduced by the use of more efficient batteries such a lithium ion power cells. But their use may also be shortened if a user person does not recharge them after every use of the article of apparel. There is therefore a need to overcome such problem.

A still further problem with the manufacture of heated articles of apparel is that articles of apparel come in different sizes to fit user persons of different statures and different gender. Therefore, different patterns are required to guide the worker person in the assembly and construction of the different size articles of apparel including different wire lengths and precise positioning as well as the interconnection of different parts. A minor error in the assembly can cause an entire system malfunction and to overcome such errors it is necessary to test the assembly before the article of apparel is sent to market. If there is a malfunction then considerable time can be loss in finding and correcting the fault often requiring the article to be dismantled. Because different assembly configurations are required, for different size and gender articles of apparel, this results in time loss during manufacture and increase risk for errors in the assembly process. Another disadvantage of prior art heating assemblies is that they are often formed of different panel parts which need to be assembled and having their wiring interconnected during the manufacturing of the article of apparel leading to errors and malfunctioning There is therefore a need to overcome this further problem.

BRIEF SUMMARY OF THE INVENTION

It is a feature of the present invention to provide an all-inclusive electrical heating liner for use in the fabrication of articles of apparel which overcomes all of the above mention disadvantages of the known prior art.

Another feature of the present invention is to provide an all-inclusive one-piece electrical heating liner for use in the fabrication of articles of apparel of different sizes including small, medium, large and X-large size articles of apparel by the use of a single heating liner.

A further feature of the present invention is to provide an all-inclusive electrical heating liner for use in the fabrication of articles of apparel and wherein the assembly is simple, foolproof, eliminates the risks of breaking wires during assembly and does not require extra skilled labor for its installation and connection and therefore requiring minimal assembly time and further providing for ease of testing, all of which results in a cost reduction of the assembly of the article of apparel.

Another feature of the present invention is to provide an all-inclusive electrical heating liner for use in the fabrication of articles of apparel and wherein the use of different size heating pads, different wire lengths and specific positioning of parts during assembly and interconnections, with the risk of the wiring being subjected to strain and severing, is substantially eliminated.

A still further feature of the present invention is to provide an all-inclusive electrical heating liner for use in the fabrication of articles of apparel of different sizes and gender and wherein the assembly is facilitated with practically no risk of damage to the heating circuits and wiring thereby resulting in a considerable reduction of liability issues at the manufacturing level and wherein the risk of damage to the heating liner is substantially reduced at the supplier, retailer and end user levels.

Another feature of the present invention is to provide an all-inclusive electrical heating liner for use in the fabrication of articles of apparel which incorporates features to prevent over-heating of the wearer person, particularly if such end user is a child or handicap person, and which heating is made automatically adjustable depending on immediate climatic condition and condition changes.

A further feature of the present invention is to provide an all-inclusive electrical heating liner for use in the fabrication of articles of apparel which prevents the risk of the batteries becoming discharged when the article of apparel is not in use and wherein there is a provision for inductive charging of the batteries without removal of the batteries from the article of apparel and wherein the batteries can be sealed and of the flexible type and further protected not to be subjected to unfavourable conditions.

A still further feature of the present invention is to provide an all-inclusive one-piece electrical heating liner for use in the fabrication of articles of apparel of different types such as jackets, pants, sleeping bags, pouches and other suitable articles formed from fabric materials.

According to the above mentioned features, from a broad aspect, the present invention provides an all-inclusive one-piece electrical heating liner for use in the fabrication of articles of apparel. The liner is constructed of a thermally insulating fabric piece shaped to define a dorsal panel and a pair of frontal panels. The frontal panels are interconnected to the dorsal panel by adjustable shoulder band sections. The dorsal panel and the pair of frontal panels each have a heating wire pattern permanently secured thereto. A power source and an on/off switch is also provided. A control module is connected to the power source and to electrical components incorporated with the heating liner. The adjustable shoulder band sections are formed to provide adjustable length thereof. An open neck area is provided between the shoulder band sections. The dorsal panel and the pair of frontal panels have seam allowance areas for fool-proof and ease of interconnection into an article of warmth. The adjustable length shoulder band sections and the outer side adjustment sections provide for the heating liner to be secured in articles of apparel within a predetermined size range.

According to a further broad aspect of the present invention there is provided an all-inclusive electrical heating liner for use in the fabrication of articles of apparel. The liner comprises a thermally insulating fabric piece shaped to define a dorsal panel and a pair of frontal panels. The frontal panels are interconnected to the dorsal panel by adjustable shoulder means. The dorsal panel and the pair of frontal panels each have a heating wire pattern permanently secured thereto. A power source and a control module is connected to the power source and to electrical components incorporated with the heating liner. The dorsal panel and the pair of frontal panels have seam allowance areas for receiving securement means into an article of warmth. The dorsal panel and the pair of frontal panels have outer side adjustable interconnection means to provide interconnectible spacing adjustment between the outer side of the dorsal panel with a respective one of the outer side of said pair of frontal panels for fitting adjustment and securement in a specific size article of warmth. The adjustable length shoulder means and the outer side adjustable interconnection means provide for the heating liner to be secured in articles of apparel within a predetermined size range.

According to a still further broad aspect of the invention there is provided an all-inclusive one-piece electrical heating liner for use in the fabrication of articles of apparel. The heating liner comprises a thermally insulating fabric piece shaped to define pant panels each having heating wire patterns permanently secured thereto and interconnected together and extending substantially transverse from a common side of a waist band section. The pant panels are constituted by a central section having an upper buttock horizontal pant panel and a pair of spaced apart depending rear leg panels adapted to provide heat to the buttock and rear legs of a wearer person, and end sections each defining front leg panels spaced from an associated one of the pair of spaced apart depending rear leg panels. A control panel section between one of the front leg panels and its associated depending rear leg panels, each section having seam allowance areas for interconnection between an outer fabric and an inner lining of a pant. Adjustable waist band sections are formed transversely across the waist band section between the sections to adapt the liner to pant waists of different sizes.

According to another broad aspect the invention provides an all-inclusive one-piece electrical heating liner for use in the fabrication of a sleeping bag. The heating liner comprises a thermally insulating fabric piece shaped to define a front and a rear sleeping bag panel each formed by elongated panels interconnected spaced apart at a common upper side edge section thereof by an adjustable fabric band section. Each front and rear sleeping bag panels having one or more heating wire patterns permanently secured thereto. The adjustable fabric band section being dimensioned to adjust the spacing between the front and rear sleeping bag panels. A control panel section extends from a top end outer area of the front panel and has at least a switch thereon accessible by a user person for connection of the beating wire patterns to a power source. Each of the front and rear sleeping bag panels have seam allowance areas for interconnection between an outer and inner fabric of a sleeping bag.

According to another broad aspect, the present invention provides an all-inclusive one-piece electrical heating liner for use in the fabrication of heated bags. The heating liner comprises a thermally insulating fabric piece shaped to define a front and a rear bag panel interconnected together by an adjustable fabric band section along a common end section by an adjustable panel section forming a bottom wall of the bag. Each the front and rear panels have one or more heating wire patterns permanently secured thereto. The adjustable fabric band section being dimensioned to adjust the spacing between the front and rear bag panels. A control panel section extends from a side edge of one of the front and rear bag panel and have at least a switch thereon accessible by a user person for connection of the heating wire patterns to a power source. Each the front and rear bag panels have seam allowance areas for interconnection between an outer and an inner fabric of a bag.

BRIEF DESCRIPTION OF THE DRAWINGS

The invention will now be described, by way of example, with reference to the accompanying drawings in which.

DETAILED DESCRIPTION OF THE INVENTION

Figure 1:
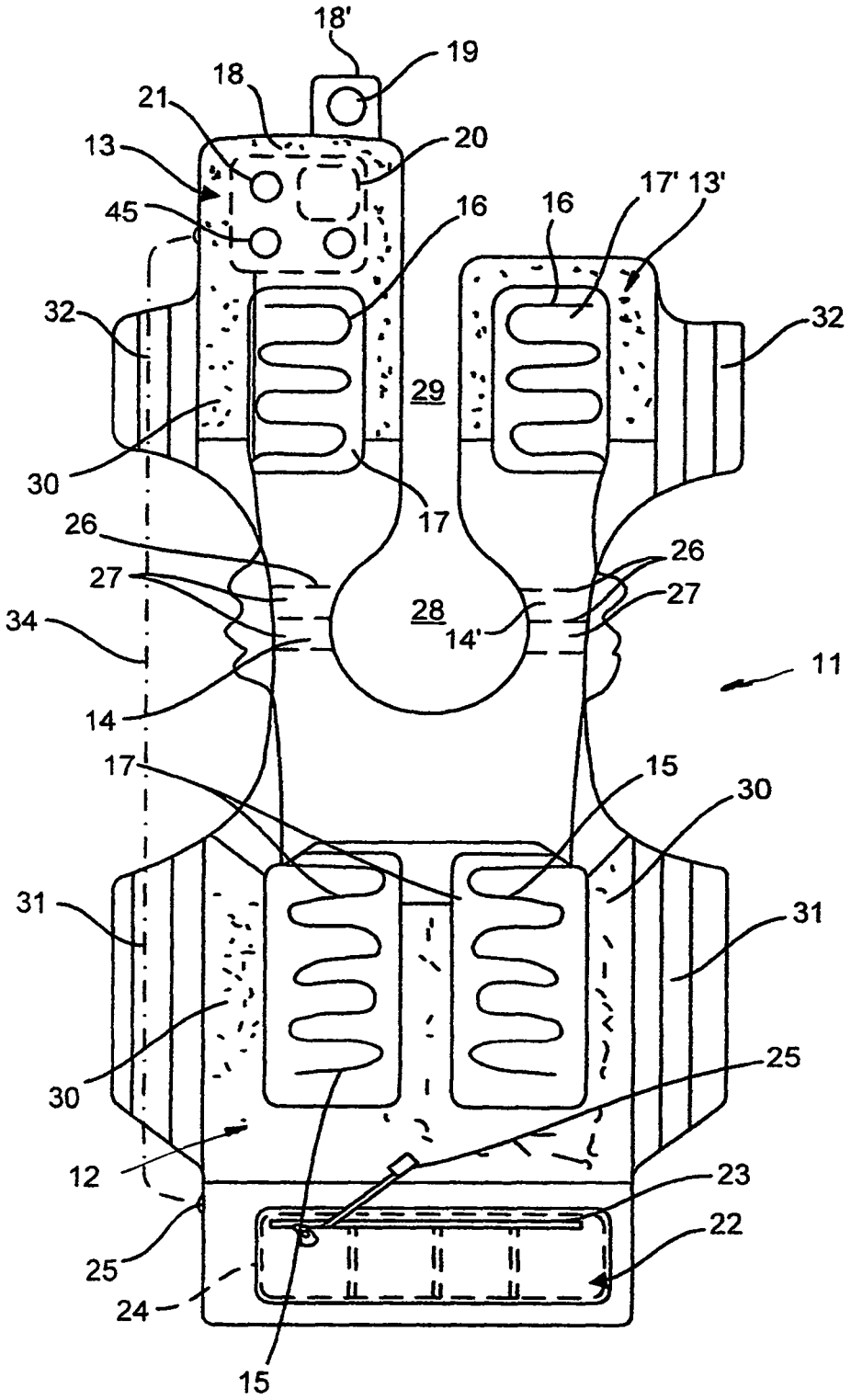
FIG. 1 is a simplified plan view of the all-inclusive electrical heating liner of the present invention constructed in a thermally insulating fabric material piece for use in the fabrication of heated articles of apparel within a predetermined size range.

Referring now to the drawings and more particularly to FIG. 1 there is shown generally at 10 a first example of the preferred embodiment of the all-inclusive electrical heating liner of the present invention. It is comprised of a thermally insulating fabric material piece 11 which is cut to define a specific shape to delineate a dorsal panel 12 and a pair of frontal panels 13 and 13'. The frontal panels 13 and 13' are interconnected to the dorsal panel 12 through shoulder band sections 14 and 14'. The dorsal panel 12 and the frontal panels 13 and 13' each have one or more heating wire patterns permanently secured thereto and has illustrated the dorsal panel has two heating wire patterns 15 and the frontal panels each have a single heating wire pattern 16. These wire patterns 15 and 16 may be in the form of pads 17 sewn or glued to the fabric piece 11. The heating wire pattern can also be formed by a conductive thread sewn directly into the fabric piece 11 in a zig-zag pattern. A heat reflective material or film 17' may be glued or otherwise secured on the surface of the fabric piece where the heating wire pattern is formed.

As shown, the frontal panel 13 is provided with an extended control panel section 18 at an end portion thereof and in which there is retained a controller and electrical components of the heating liner. An extended tab 18' extends from the outer edge of the panel section 18 and an on/off button switch 19 is secured thereto to activate the heating system through a controller module 20 which incorporates a microcontroller, not shown but obvious to a person skilled in the art, which has a memory in which is stored programmed functions for its execution. It is pointed out that the controller 20 may be incorporated with the switch 19 assembly in a common module. Connector 21 is also provided to connect to an auxiliary power supply, not shown, or for other functions.

Figure 5A:
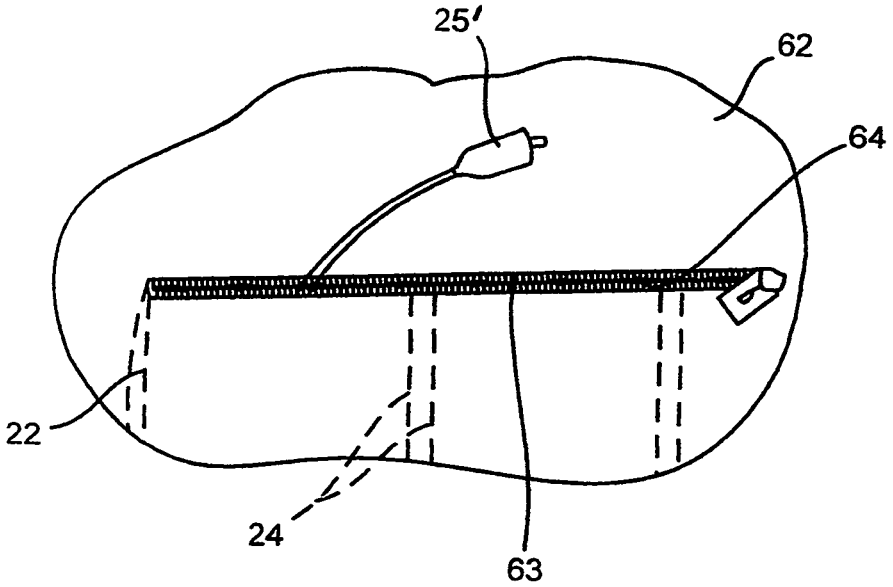
FIG. 5A is a fragmented view of the inner liner of an article of apparel fitted with the heating liner of the present invention and showing a closable access slot formed in the inner liner of the article of apparel for access to the battery charging connector located in the battery pouch formed in the dorsal panel.

The dorsal panel 12 has a pouch 22 formed along a lower edge thereof. The pouch 22 has a slit opening 23 for the insertion and removal of a dc battery pack 24 for washing the article of apparel. The battery is preferably a flexible battery pack, whereby to conform to the back of a wearer person of an article of apparel in which the electrical heating liner 10 is secured. The pouch is fitted with a connector 25, herein a supply wire connector 25 to the controller and a charging connector 25', which is accessible from an inner liner (not shown) of an article of apparel through a zipper closure 63, as shown in FIG. 5A to provide for the charging of the batteries without removal of the battery pack 24 from the pouch. The charging connector 25' may also be an induction charging connector fitted with a coil for the induction transfer of power to the battery pack 24. The charging connector 25' can also be connected to a long wire whereby to be coupled to an exterior charging port associated with a garment hook or hanger to provide a charging connection when the article of apparel is not worn and hung from the hook or hanger, see FIG. 7. The invention further contemplates that the battery pack can be retained in a sealed pouch with a connector for the supply and charging of the batteries.

The shoulder band sections 14 are made of predetermined length and provided with length adjustment means, herein in the form of delineated transverse line formations 26 to define adjustable length sections 27 of the band by pleating, cutting and stitching or gluing. These bands provide for adjusting the spacing between the dorsal panel and the pair of frontal panels to adapt the liner 10 to articles of apparel of small, medium, large and X-large garment sizes. By overlapping and stitching some of the sections 27 the length of the bands can be modified to adjust the position of the pads 17 and 17' on articles of apparel of different size. This simple adjustment feature does not require much labor content, is simple and economical. As shown, an open neck area 28 is defined between the shoulder band sections 14 and 14' and merges into an open space 29 between the pair of frontal panels 13 and 13'. Seam allowance areas 30 are also defined in specific areas of the liner, to provide to the manufacturer of heated articles of apparel, stitching or gluing areas where the liner can be attached to an inner liner material of the article of apparel. These seam allowance areas 30 are free spaces where wires are not present.

As shown in FIG. 1, the dorsal panel 12 and frontal panels 13 and 13' may also be provided with outer side adjustment extension sections or flaps 31 and 31', respectively, to provide for interconnectible spacing adjustment between the outer side adjustment flaps 31 of the dorsal panel 12 with a respective one of the outer side adjustment flaps 32 of the pair of frontal panels 13 and 13'. This provides for further side spacing adjustment to fit the electrical heating liner 10 of the present invention in certain articles of apparel of small, medium, large and X-large size range although such is herein represented as an added feature which may be desirable in the fabrication of certain articles, such as vests for various uses.

Figure 2:
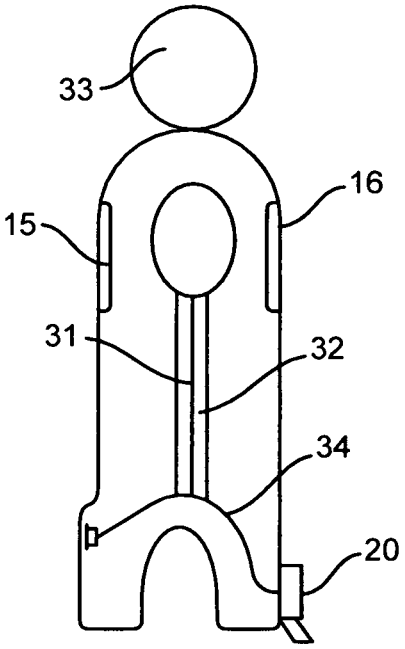
FIG. 2 is a simplified side view illustrating the position of the all-inclusive electrical heating liner of the present invention when fitted into an article of apparel, such as a vest.

FIG. 2 illustrates the position of the electrical heating liner 10 when secured to an article of apparel such as a vest (not shown here) and worn by a wearer person 33. Has can be noted, the power distribution wiring to the heating wires 15 and 16 extends to the outside of the panels 12, 13 and 13' and do not extend through the shoulder band sections 14 and 14' where adjustment is provided. Furthermore, the supply voltage from the battery pack 24 is connected to the controller 20 via an external supply wire 34 connected at one end to the power connector 25 of the battery pouch and secured to the battery pack 24 at one end and to the controller 20 at the other end through a further wiring. These wire interconnections extend in the hip area of the article of apparel where there is negligible stretching when the article of apparel is worn as opposed to the should and arm areas. All of the power supply wiring is also immovable retained on the surface of the fabric material by glue, tapes or other means to prevent them from moving during assembly of the liner 10 within an article of clothing during its fabrication and to retain them in secured areas outside the seam allowance areas 30.

Figure 3:
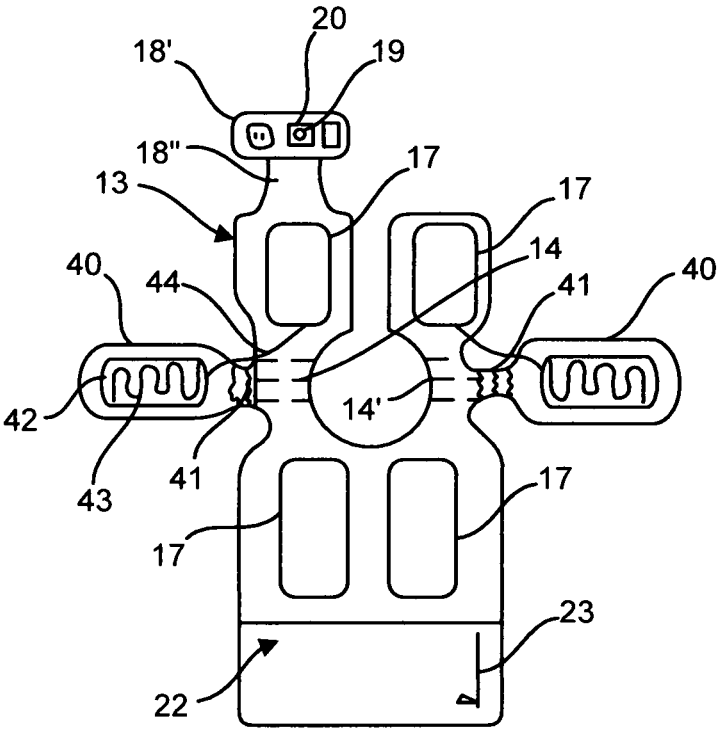
FIG. 3 is a simplified plan view, similar to that shown in FIG. 1 but modified to incorporate arm heating sections formed with the thermally insulating fabric piece.

Referring now to FIG. 3 there is shown a further example of the all-inclusive electrical heating liner of the present invention wherein the thermally insulating fabric piece 11 further delineates arm heating pads 40 integrally formed and interconnected with each of the shoulder band sections 14 and 14'. The arm heating pads 40 extend transversely outwards by interconnection adjustable bands 41 which are formed for shortening the distance of the pads 40 from the shoulder bands 14, 14' depending on article sizes, As also shown in FIG. 3, the panel section 18' is connected to the frontal panel 13 by an extension panel section 18" to permit fixing the panel 18' to an inner liner visible to the wearer and providing access to the various controls. A heating pad 42 having heating wires 43 is secured to the arm heating bands 40. The heating wires 43 are connected to a supply wire 44 which bridges the length adjustment length sections 27 of the shoulder bands 14 and 14' and which is of sufficient length not to intrude with modifications of the shoulder bands and to permit arm movement without strain on the supply wire 44. It is also contemplated that the article of apparel can be a detachable heating liner which is detachably retained inside an article of apparel by means of a zipper or other detachable means.

Figure 4A:
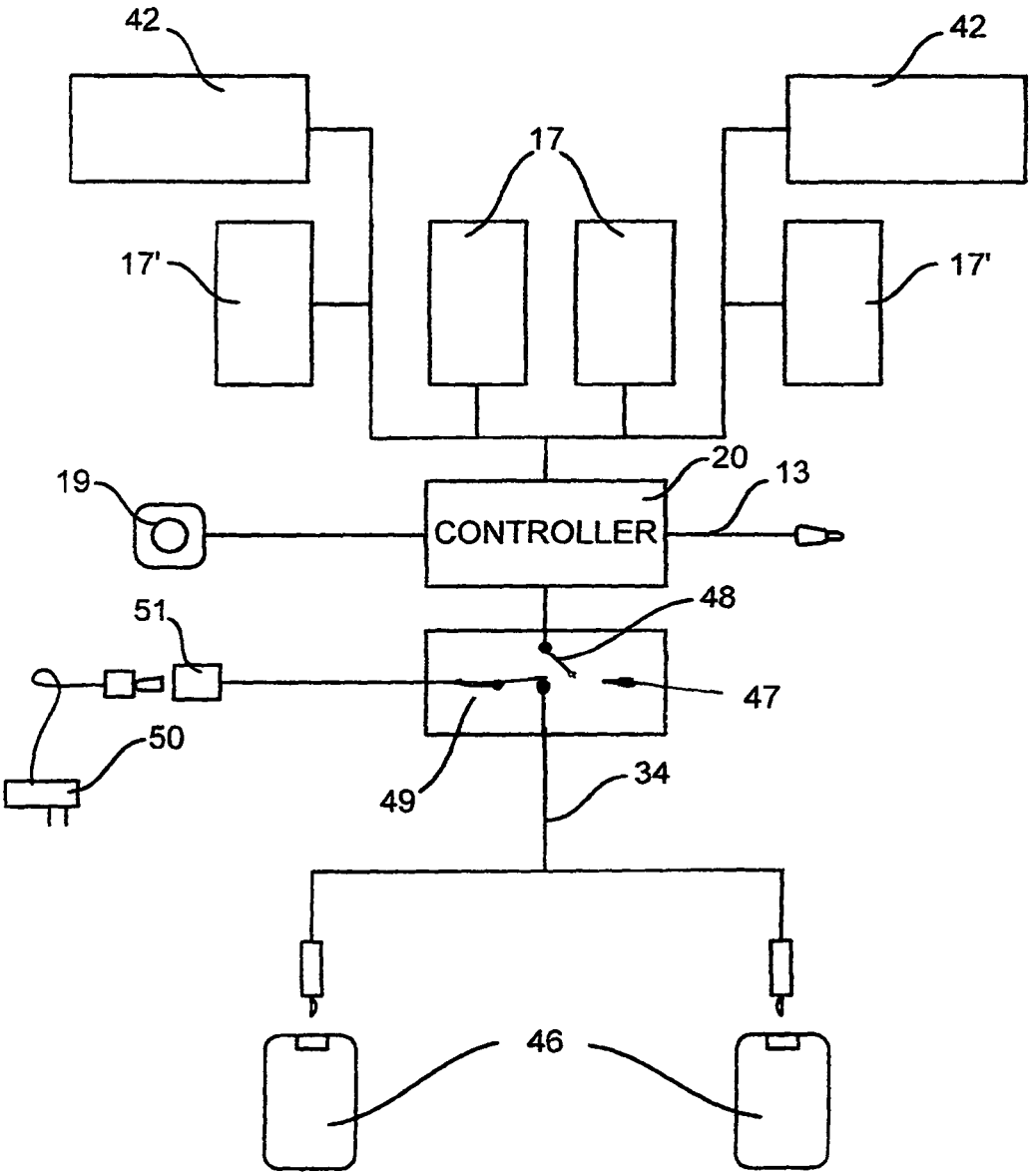
FIG. 4A is a simplified block diagram illustrating one aspect of the electrical circuit interconnecting heating elements of specific sections of the heating liner and certain electrical components and controls thereof.
Figure 4B:
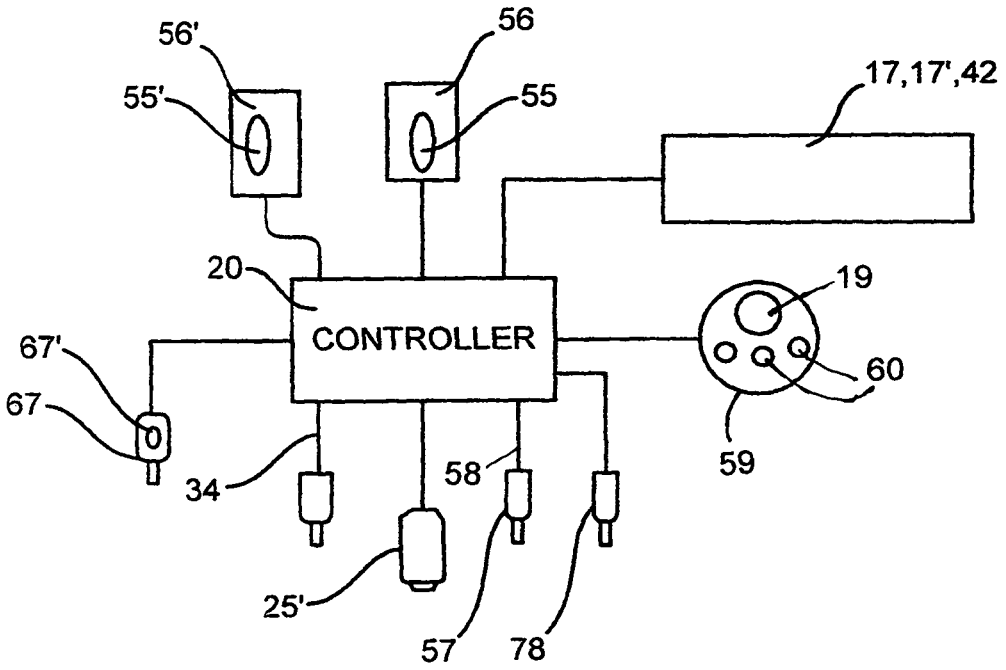
FIG. 4B is a further simplified block diagram illustrating another configuration of the electrical circuit and the use different connectors and devices connected to the controller of the heating liner.

With reference to FIGS. 4A and 4B, the electrical circuit and its components as well as accessories will be described. When the all-inclusive electrical heating liner 10 is secured to an article of apparel, the control on/off button switch 19 is made accessible to the wearer person through a slit made in the inner liner of the article of apparel and projecting from the lower edge of the article of apparel. It could also be made from the inside of the article of apparel. The on/off switch 19 activates the heating system and places the controller into operation to automatically execute its functions. As shown in the wiring illustration of FIG. 4A, the power pack 24 is provided by lithium ion batteries 46, two being illustrated, and connected to the controller by the power lead 34 and through a switch 47 mounted inside the control panel 18. This switch 47 is herein shown in its battery charging mode with its switch arm 48 open, when the on/off button switch 19 is "off", to cut the supply of the batteries 46 from the controller 20, and switch arm 49 closed to provide for an external power source to be connected to the batteries for charging the batteries. The external power source is herein shown as constituted by an ac/dc converter plug 50 adapted to be connected to an household power outlet not shown, to supply a 10 or 12 volt dc supply via a charging connector 51 accessible outside the pocket 20 or to the plug connector 21 mounted on the outer surface of the control panel 18 as shown in FIG. 1 when the on/off button switch is "on", the switch arm 48 closes.

FIG. 4B illustrates further accessories provided with the controller 20. As herein shown, temperature sensors 55 and 55' are connected to the controllers via their wiring and these sensors are secured to fabric patches 56 and 56' respectively for mounting these temperature sensors at discrete locations on the outer shell and the inner liner of the article of apparel whereby sensor 55 is secured to the inner liner to sense the temperature between the inner liner and the wearer person. The other temperature sensor 55' is mounted on the outer shell to sense the external temperature of the article of apparel. These temperature readings are fed into the microcontroller and based on these readings the controller can maintain a comfortable inner temperature against the body of the wearer person or shut off the electrical heating elements if the temperature reaches an uncomfortable programmed temperature. It also detects if the article of apparel is not worn and the power source is still operative and thereby causing a shut-down the power to the heating elements to save the charge in the battery pack. The controller may also be provided with a USB port accessible at the control panel to download information into the microcontroller or extract information therefrom. An auxiliary power plug 57 with an extension cord 58 is also provided for connection to an external power source such as a battery of a motorcycle, an ATV, snowmobile or other pleasure vehicles operated in cold climatic conditions. It is pointed out that many of these connectors can be magnetic type connectors wherein the plug and socket of the connections is further retained by magnetic force to prevent detachment. Also, the connections when made by the manufacture of the article of apparel can be taped or glued in place to prevent disconnection from inside the article of apparel.

Figure 8:
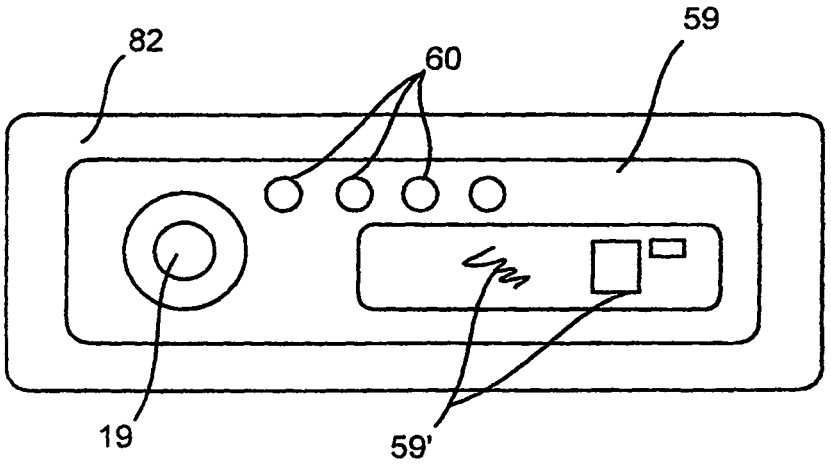
FIG. 8 is a front view of a user accessible control incorporating the on/off button switch and other visual devices and components secured to the inner liner of an article of apparel or a modified tab of the all-inclusive electrical heating liner of the present invention.

FIGS. 4B and 8 further illustrate modification to the on/off switch button 45. As herein show, the on/off button 19 is mounted in a module 59 having charge indicator lights 60 visible on the outer surface of the module to indicate the percent charge of the battery to the wearer person. If the user has an auxiliary power supply and the charge indicator shows a very low charge then the auxiliary plug 57 can be connected to the auxiliary power supply which can be in the form of a flexible battery belt, which is known in the art. As shown in FIG. 8 the switch module 59 may be secured to a fabric patch 82 for attachment to the outer shell of the article of apparel and may also be provided with a display screen 59' to display various modes of operation of the controller or other information.

FIG. 5A illustrates the access to the battery pack 24 located in the pouch 22 of the heating liner 10 secured behind an inner liner 62 of an article of apparel. As shown, a zipper closure 63 is secured in a slit opening 64 formed in the inner liner adjacent the slit access to the pouch to provide access to the batteries 24 and the charging connector 25'.

Figure 5B:
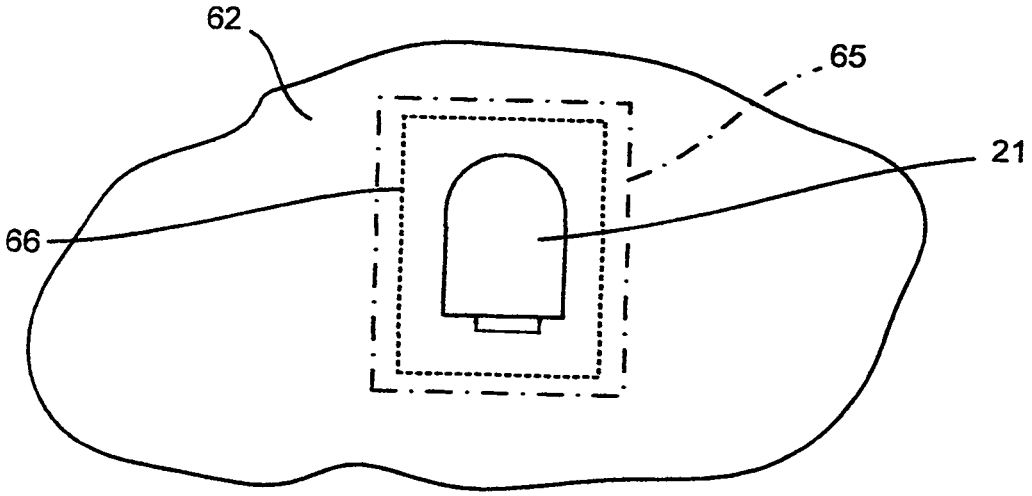
FIG. 5B is a fragmented view of the inner liner showing an auxiliary connector connected to the controller.

FIG. 5B shows the connector 21 also secured to the inner liner 62 for access internally of the article of apparel. The connector 21 is secured to a material patch 65 secured to the inner liner 62 by a stitch seam 66.

Figure 6A:
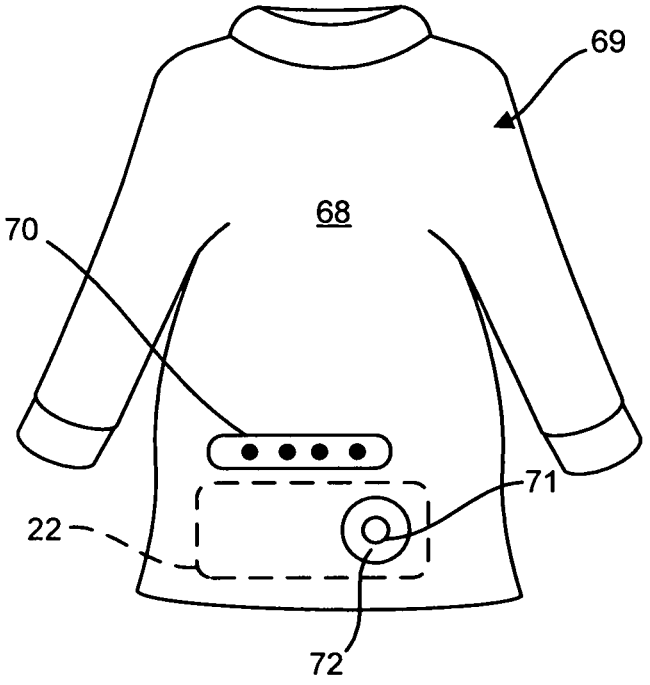
FIGS. 6A and 6B are schematic illustrations of a front and rear view of a jacket type article of apparel incorporating therein additional features of security that can be controlled and operated by the controller of the heating liner of the present invention.
Figure 6B:
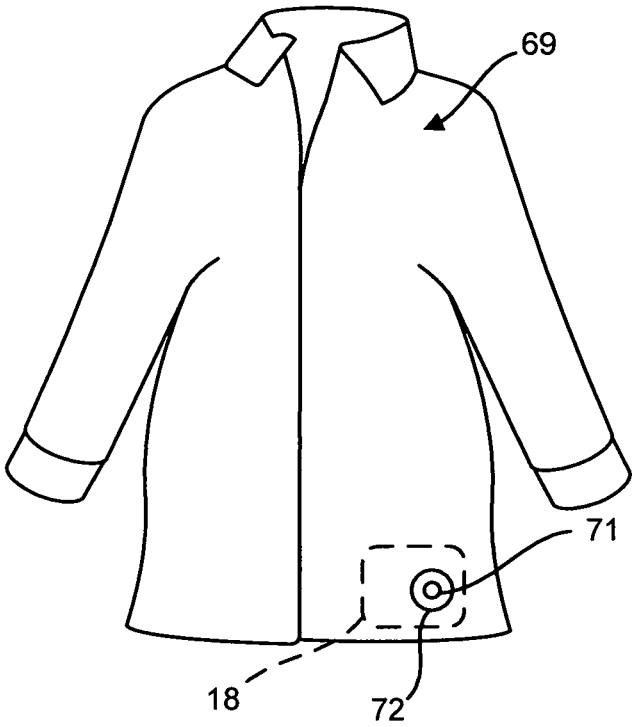

FIGS. 6A and 6B shows another feature that can be associated with the control module 20 wherein a band of safety lights 70 is made available on the rear wall 68 of the outer shell of the article of apparel 69, and attached thereto in the immediate area of the battery pouch 22 to facilitate wiring connection to the lights and the running of wires or may be provided with a single red flashing light with 71 with a surrounding reflector 72 secured thereto to signal the presence of the wearer person during night time. This mode of operation is actuated by the wearer person depressing a button switch 67' on a module 67" of the connector 67, shown in FIG. 4B. FIG. 6B shows that the same feature of flashing lights can also be mounted on the outer shell at the front of the article of apparel 69 in the immediate area of the panel 18 where the controller is mounted.

Figure 7:
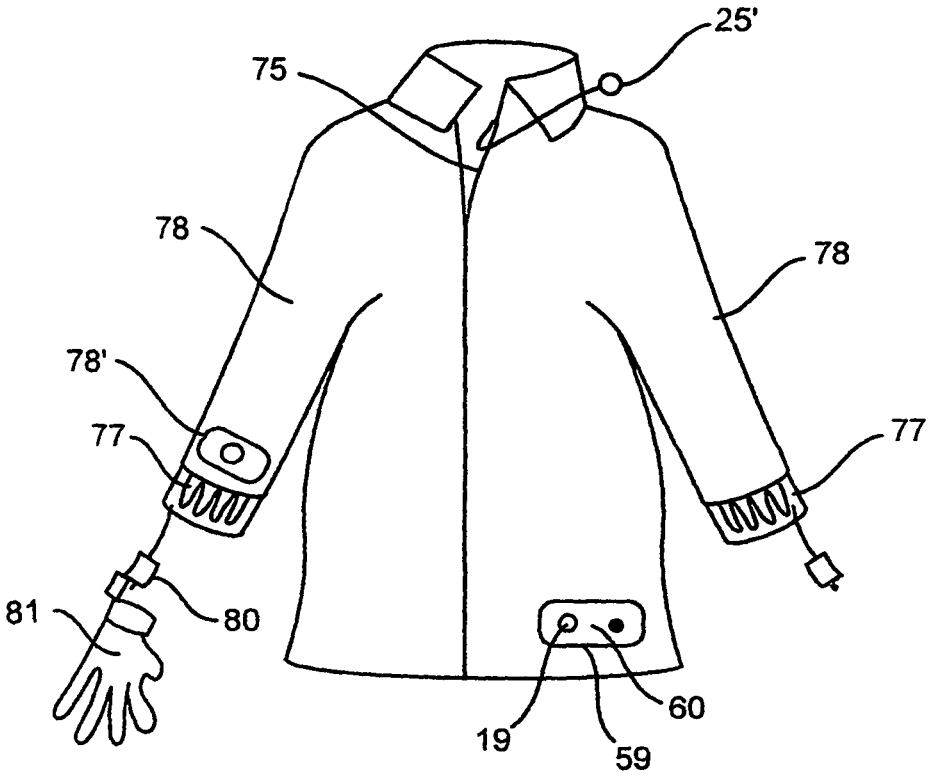
FIG. 7 is a front view of a jacket type article of apparel incorporating therein still additional features that can be incorporated with the article of apparel and controlled and operated by the controller of the heating liner of the present invention.

FIG. 7 illustrates a still further feature that can be adapted to the all-inclusive electrical heating liner of the present invention. As herein illustrated, the inductive charging connector 25' is herein shown conveniently mounted at the front area of the neck opening 75 of the jacket type article of apparel 76 for connection to a charging port mounted adjacent a hanger (not shown) to store the article of apparel when not in use. Further, instead of the tab 19 to which is mounted the on/off switch button 19, a switch button module 59 of the type shown in FIG. 8 can be mounted directly on the outer shell of the article of apparel in the vicinity of the control panel 20. As further shown in FIG. 7, the article of apparel 76 is provided with heating cuffs 77 at opposed ends of the arms 78 thereof. A switch module 78' is sewn into the outer shell of the arms 78 to switch the supply of power to heating wires 79 mounted within the cuffs. These cuffs are formed as extensions which are rolled back and unrolled over the hands of a wearer person to provide heat thereto. Alternatively, or in combination therewith, heated gloves 81, which are also known in the art, can be connected to connectors 80 accessible from the cuffs 77 to provide power to heating wires, not shown, securely mounted within the gloves.

Figure 9A:
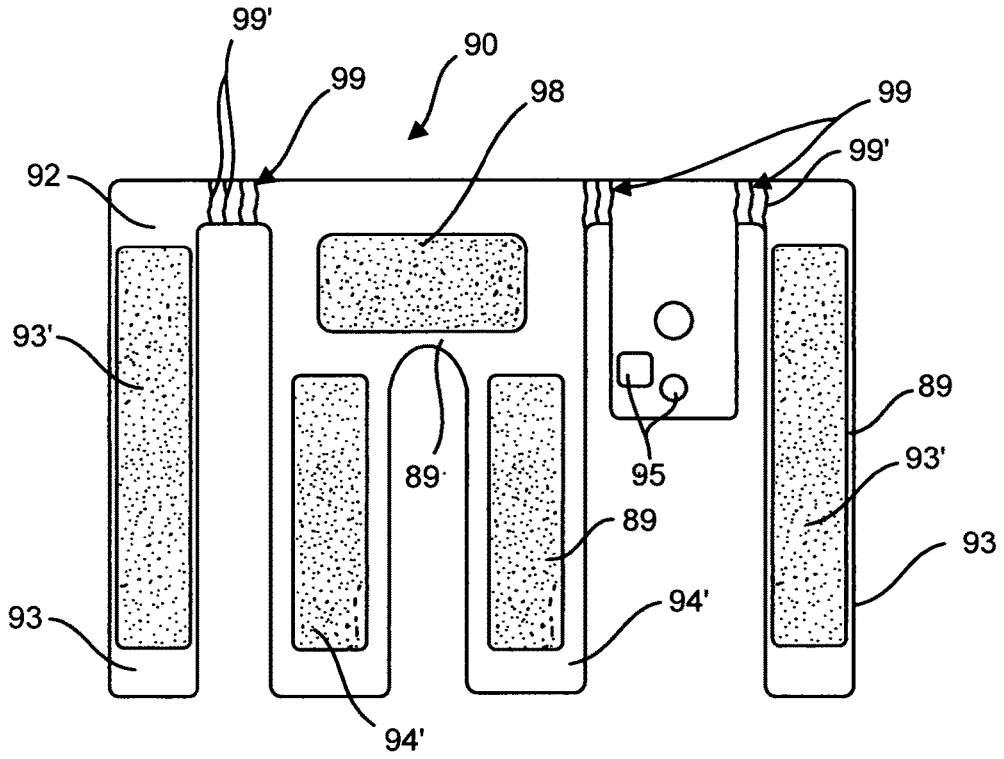
FIG. 9A is a plan view of a one-piece electrical heating liner of the invention for use in the fabrication of heated pants.
Figure 9B:
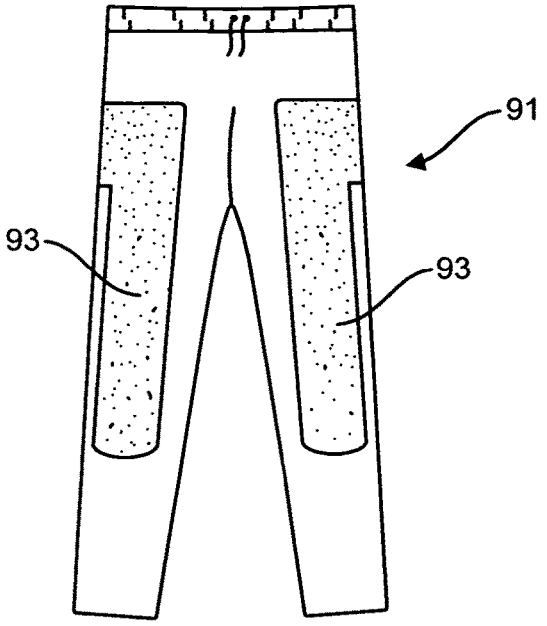
FIGS. 9B and 9C are front and rear views respectively showing the position of the heating liner of FIG. 9A secured in a pant article of apparel.
Figure 9C:
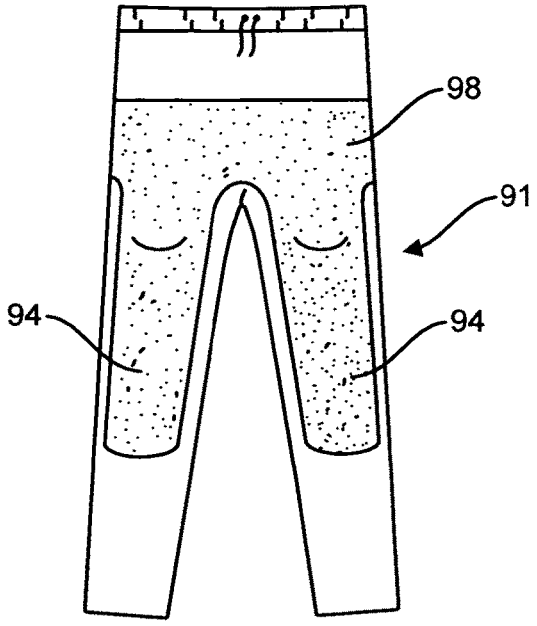

With reference now to FIGS. 9A to 9C there is illustrated at FIG. 9 an all-inclusive one-piece electrical heating pant liner 90 for use in the fabrication of heated pants 91 as illustrated in FIGS. 9B and 9C. The heating liner 90 is formed in a thermally insulating fabric 92 as previously described and which is shaped to define front pant panels 93 and rear pant panels 94. The panels 93 and 94 are of generally elongated rectangular form and provided with patches 93' and 94' having heating wires sewn therein in a manner as previously described and interconnected together and to controls 95 secured in a control fabric panel 96. All of the panels 93, 94 and 96 depend transversely from a common side of a waist band section 97.

The rear pant panels 94 are shorter than the front pant panels 93 for the reason that an upper buttock horizontal patch 98 is secured there above to provide heat to the buttock section of a wearer person as is illustrated in FIG. 9C. Further, and in accordance with the invention, in order to adapt the pant liner 90 to pants of different waist sizes, there is provided adjustable waist band sections 99 formed transversely across the waist band section 97 and constituted by fabric pleats 99' which provide for extension or shortening of the waist band section 97 whereby to adapt the heating pant liner 90 to pants having waist sizes ranging from small to x-large sizes. Seam allowance areas 89 are provided about the liner and its parts for securement to an article of apparel.

Figure 10A:
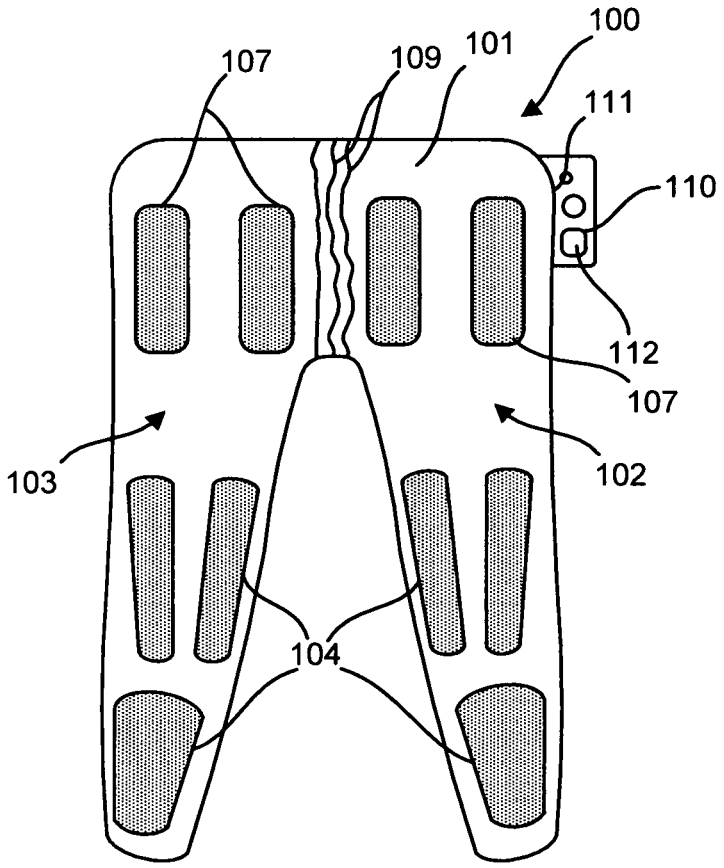
FIG. 10A is a plan view of a one-piece electrical heating liner of the invention for use in the fabrication of a sleeping bag.
Figure 10B:
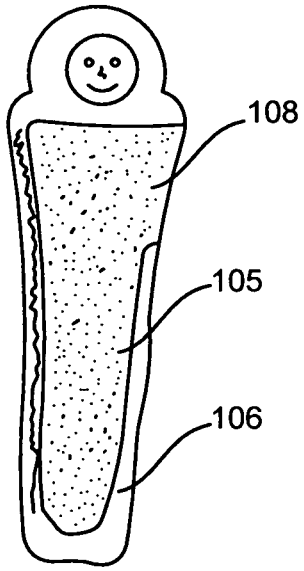
FIG. 10B is a front view of a sleeping bag having incorporated therein the heating liner of FIG. 10A.

With reference now to FIGS. 10A and 10B there is illustrated another application of the all-inclusive one-piece heating liner of the present invention and herein more specifically a sleeping bag liner 100. It is also comprised of a thermally insulating fabric piece 101 as previously described and shaped to define a front sleeping bag panel 102 and a rear sleeping bag panel 103. The panels 102 and 103 are elongated panels disposed side-by-side and spaced a predetermined distance from one another and of a size suitable for accommodating most size user person's. Different size and shaped patches 104 having heating wire patterns therein as above described at located in the panels 102 and 103 to provide heat in the mid-lower section 105 of a sleeping bag 106, as illustrated in FIG. 10B. Additional patches 107 with heating wires are also strategically positioned in the sleeping bag liner 100 to provide controlled heat in the upper section 108 of the sleeping bag 106. A control panel 110 extends from the outer top edge 111 of the front sleeping bag panel 102 and in which is secured the various controls 112 to switch on and adjust the temperature of the sleeping bag 106. This panel may also be detachable and have an extension cable for positioning inside the sleeping bag at a convenient location for access by the user person.

In order to adapt the sleeping bag heating liner 100 to sleeping bags of different sizes, adjustable fabric pleats 109 are formed in the upper section 108 of the liner 100 centrally between the upper patches 107 of the two panels 102 and 103, thus permitting the panels to separate from one another to accommodate securement of the heating liner 100 in larger sleeping bags.

Figure 11A:
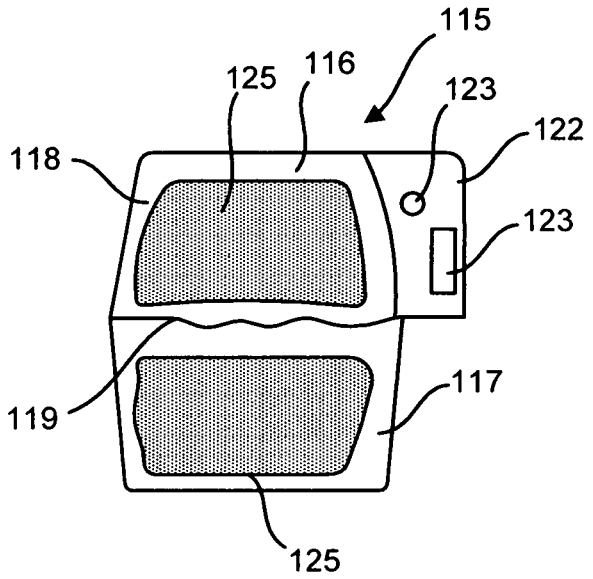
FIG. 11A is a plan view of a one-piece electrical heating liner of the invention for use in the fabrication of a heated bag.
Figure 11B:
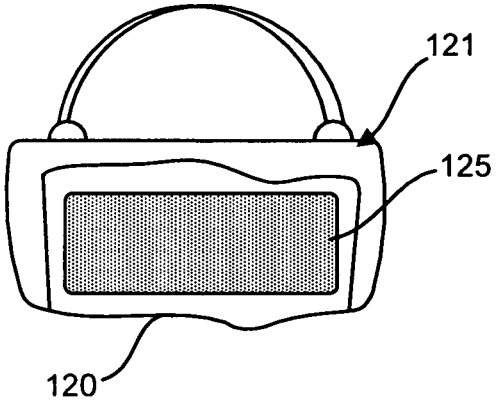
FIG. 11B is a side view of a bag having incorporated therein the heating liner of FIG. 11A.
Figure 11C:
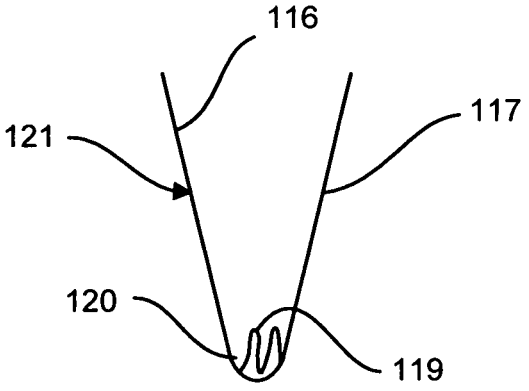
FIG. 11C is a simplified side view showing the adjustable feature of the heating liner of FIG. 11A.

With reference now to FIGS. 11A to 11C, and specifically to FIG. 11A, there is shown an all-inclusive one-piece bag heating liner 115. It is also comprised of a thermally insulating fabric piece 116 shaped to define a front bag panel 117 and a rear bag panel 118 interconnected together by an adjustable fabric band section 119. The band section 119 interconnects the panels together and form a bottom wall 120 of a heated bag as shown at 121 in FIGS. 11B and 11C. The fabric band section is pleated inside the bag 121 as shown in FIG. 11C. Also, a control panel provided with controls 123 is formed from an edge of either panels 117 and 118 and folded inside the bag 121 and secured to an inner lining or through a slit formed in an inner lining for access by a user person and as is obvious. As for the other embodiments, patches 125 containing heating wire patterns are secured to each of the panels 117 and 118. Also, seam allowance areas, as previously described, are provided about the panels for interconnection of the bag heating panel 115 between an outer an outer fabric material and an inner liner of the bag 121.

The all-inclusive electrical heating liner of the present invention is fabricated from a convenient fabric material having thermal insulation properties and which may also include an air permeable reflective inner surface to which the heating wire patters are secured to reflect heat internally of the article of apparel in the direction of the wearer person.

The term "all-inclusive" as used herein is intended to mean that the electrical heating liner is formed to provide a clothing manufacturer a heating liner which contains all operating parts in a single liner fabric piece making its incorporation into an article of apparel simple without having to attach different parts, precisely position wiring, and to interconnect the parts together. It also provides security in that all wiring is free from seam allowance areas which delineate areas where stitching or other form of connection can be safely made for incorporating the heating liner without risk of damaging the heating liner wiring and component parts, thereby substantially eliminating liability issues. All controls, wiring, batteries, switches and connectors are inclusive and there is no need of assembly thereof and there is no need for greater skilled labour. Further, because the heating liner is provided with simple adjustment means to fit the single heating liner in articles of apparel of different sizes and gender including small, medium, large and X-large size range, there is a saving in inventory and a reduction in confusion and incorrect installation of the heating liner. The all-inclusive construction of the heating liner results in a cost reduction to the manufacture and a reduction in errors in its incorporation into the fabrication of articles of apparel.

It is also pointed out that the control module 20 can also have a surface portion provided with a screen and buttons to enable various features and made available from the outer surface of the inner liner 62 of the article of apparel. Other modifications obvious to a person skilled in the art are contemplated for access to connectors, switches and controls as illustrated in the block diagrams of FIGS. 4A and 4B.

It is within the ambit of the present invention to cover all obvious modifications of the examples of the preferred embodiment described herein provided such modifications fall within the scope of the appended claims.

The invention claimed is:

1. An all-inclusive one-piece electrical heating liner for use in the fabrication of articles of apparel of different sizes, said liner comprising a thermally insulating fabric piece shaped to define a dorsal panel and a pair of frontal panels, said frontal panels being interconnected to said dorsal panel by adjustable shoulder band sections, said dorsal panel and said pair of frontal panels each having a heating wire pattern permanently secured thereto, a power source, an on/off switch, a control module connected to said power source and to electrical components incorporated with said heating liner, said shoulder band sections being formed to provide adjustable length thereof, an open neck area between said shoulder band sections, said adjustable dorsal panel and said pair of frontal panels having seam allowance areas for permanent interconnection into an article warmth, said dorsal panel and said pair of frontal panels having outer side adjustment sections to provide interconnectable spacing adjustment between said outer side adjustment sections of said dorsal panel with a respective one of said outer side adjustment sections of said pair of frontal panels for fitting adjustment and securement in a specific size article of warmth, said shoulder band sections and side adjustment sections being each provided with delineated transverse line formations to define adjustable length sections for pleating and permanent securement of said pleats to one another to define a desired length for adjusting the spacing between said dorsal panel and said pair of frontal panels to adapt said electrical heating liner for permanent connection to a selected apparel size of said articles of apparel of different sizes, and wherein said heating wire pattern of said dorsal panel and said pair of frontal panels are interconnected by a wire which detachably extends from said dorsal panel to said pair of frontal panels across said adjustable shoulder band sections.

2. The all-inclusive one-piece electrical heating liner as claimed in claim 1 wherein one of said frontal panels has an extended control panel section at an end portion thereof in which there is retained a controller and electrical components to control a supply voltage from said power source to operate selected ones or all of said heating wire patterns to provide control heat to a wearer person.

3. The all-inclusive one-piece electrical heating liner as claimed in claim 2 wherein said dorsal panel has a pouch formed at an outer bottom section thereof, said power source being a battery supply removably stored in said pouch, an external conductive wire interconnecting said battery supply to said control module, said external conductive wire bridging a side hip area of said article of apparel when said heating liner is secured thereto.

4. The all-inclusive one-piece electrical heating liner as claimed in claim 3 wherein said pouch is provided with a closable access opening for the insertion and removal of said battery supply, said battery supply having a power cable connector and a charging cable secured thereto to provide connection to said controller and the charging of said battery supply.

5. The all-inclusive one-piece electrical heating liner as claimed in claim 3 wherein said extended control panel section has an extension panel section to provide an extension for securing said control panel section separately on an inner liner of an article of apparel to provide access to said on/off switch to a wearer person.

6. The all-inclusive one-piece electrical heating liner as claimed in claim 2 wherein a tab portion of said control panel section of said frontal panel projects outside an inner lining or an outer fabric of said article of apparel to provide access to an on/off switch whereby a user person can activate and de-activate said power supply.

7. The all-inclusive one-piece electrical heating liner as claimed in claim 2 wherein there is further provided an auxiliary battery supply port in an inner liner of an article of apparel to which said heating liner is secured to connect an external battery supply to said controller.

8. The all-inclusive one-piece electrical heating liner as claimed in claim 2 wherein there is further provided heating gloves removably connectable to cuffs of said article of apparel, said heating gloves having heating wires mounted therein and having a power connector for securement to a power source connector accessible at said cuffs, said control module providing power to said heating gloves and to heating wires provided in said cuffs when a switch mounted in the arms of the article of apparel is activated by a user person.

9. The all-inclusive electrical heating liner as claimed in claim 8 wherein said on/off switch is a button switch having a connection to said control module and said power supply, said button switch having a display panel to provide a visual indication of a mode of operation of said control device, said control device being a microcontroller module having a memory for storing programmed functions for execution by said microcontroller module.

10. The all-inclusive one-piece electrical heating liner as claimed in claim 1 wherein said heating wire patterns is constituted by one of electrically conductive filaments sewn in patterns and into discrete areas of said fabric piece defining said dorsal and frontal panels, and pads containing heating wire patters secured to discrete areas of said fabric piece defining said dorsal panel and said pair of frontal panels.

11. The all-inclusive one-piece electrical heating liner as claimed in claim 1 wherein said article of apparel is one of a vest, a jacket and a coat.

12. The all-inclusive one-piece electrical heating liner as claimed in claim 1 wherein said heating liner is secured in a removable inner liner which is removably secured inside a jacket or a coat by detachable fastener means.

13. The all-inclusive one-piece electrical heating liner as claimed in claim 1 wherein said heating liner further comprises arm heating pads integrally formed with said fabric piece and interconnected with each said shoulder band sections by a narrow interconnection band extending outwardly thereof and substantially transverse on a respective side of said open neck area, said narrow interconnection band being formed to provide adjustable length thereof and a heating wire pattern in each said arm heating pads.

14. The all-inclusive one-piece electrical heating liner as claimed in claim 1 wherein said control module is a microcontroller module connected to said power source through a switching circuit operated by said on/off switch, said microcontroller module having a memory for storing therein programmed functions for execution, said on/off switch being mounted in a depending tab section extending at an end portion of one of said frontal panels for access outside said article of apparel in which said heating liner is secured, said on/off switch operating a switch means to connect power from said power source to said microcontroller module.

15. The all-inclusive one-piece electrical heating liner as claimed in claim 14 wherein said switch means has a first switch contact secured to a charging plug accessible outside said inner liner for connection a charging voltage supply when said on/off switch is in an "off" state, and a second switch contact connected to said power source through one or more wire connectors when said on/off switch is in an "on" state, said power source being one of a power pack retained in a pouch of said dorsal panel.

16. The all-inclusive one-piece electrical heating liner as claimed in claim 15 wherein said microcontroller module is further provided with a connection to one or more temperature sensors adapted to sense external and internal temperature in the environment of said article of apparel when worn by a user person whereby to automatically control power supplied to said heating wires patterns dependent on sensed temperature signals received from said temperature sensors.

17. The all-inclusive one-piece electrical heating liner as claimed in claim 16 wherein all of said heating wire patterns are interconnected by a supply wires retained on said fabric piece spaced securely from said seam allowance areas and extending in said dorsal panel and said pair of frontal panels and about shoulder band sections and terminating at a power connector secured and accessible at said control pouch section, and an external power cable interconnecting said power supply to said power connector when said heating liner is secured in said article of apparel.

18. The all-inclusive one-piece electrical heating liner as claimed in claim 1 wherein there is further provided patches of lights for securement to said article of apparel and having a communication connection to said control module, said control module being a microcontroller module having a programmed function stored in a memory thereof for operating said lights when said programmed function is initiated by said controller by command input device from a user person of said article of apparel.

19. The all-inclusive electrical heating liner as claimed in claim 1 wherein said fabric piece has an air permeable heat reflective inner surface to which said heating wire patterns are secured for reflecting heat generated by said heating wires internally of said article of apparel.

20. The all-inclusive electrical heating liner as claimed in claim 1 wherein an induction charging device is secured to said power source for induction charging of said power source from a charging port associated with a hanger for the storage of said article of apparel when not worn.

* * * * *